United States Patent [19]

Aoki

[11] 4,429,495

[45] Feb. 7, 1984

[54] DOOR FOR BUILDINGS

[75] Inventor: Kiyomi Aoki, Yokohama, Japan

[73] Assignee: Mitsui Metal Processing Co., Ltd., Tokyo, Japan

[21] Appl. No.: 290,494

[22] Filed: Aug. 6, 1981

[51] Int. Cl.[3] ..... E06B 3/00

[52] U.S. Cl. ..... 49/501; 49/394; 49/400; 49/503; 49/504; 52/167; 292/341.11; 292/DIG. 38

[58] Field of Search ..... 49/501, 503, 504, 400, 49/401, 381, 394; 52/167; 292/341.11, 341.12, DIG. 38, DIG. 56, DIG. 57

[56] References Cited

U.S. PATENT DOCUMENTS

| | | | |
|---|---|---|---|
| 2,073,149 | 3/1937 | Geyer | 292/DIG. 38 |
| 2,946,614 | 7/1960 | Russell | 292/341.11 |
| 3,364,298 | 1/1968 | Peters | 49/501 X |
| 3,492,038 | 1/1970 | Schlage et al. | 292/341.12 X |
| 4,018,475 | 4/1977 | Richtermeier | 49/400 X |
| 4,165,112 | 8/1979 | Kleefeldt | 292/341.12 X |
| 4,328,644 | 5/1982 | Scott et al. | 49/501 |

FOREIGN PATENT DOCUMENTS

| | | |
|---|---|---|
| 55-29610 | 2/1980 | Japan . |
| 55-47586 | 3/1980 | Japan . |

*Primary Examiner*—Philip C. Kannan

[57] ABSTRACT

The invention provides a door for buildings, comprising the outside panel thereof being larger in area than the inside panel thereof, the four edge faces of the door being provided on their outside portions with acute-angled projecting portions, the outside portions of the inner faces of a door frame being inclined toward the outside, the clearances between the inner faces of the door frame and the inside portions of the edge faces of the door being at least 6 mm each; and a door for buildings provided with a lock having clearances of at least 6 mm each over and under a dead bolt or a latch bolt when said bolt is inserted into a bolt recess.

9 Claims, 18 Drawing Figures

Displacement Effect of External Forces on Building and Non-Load-Bearing Wall

Displacement Effect of External Forces on Door Clearances and Lock Clearances

| | (I) Normal State | (II) When subjected to horizontal external force from the lock side | (III) When subjected to horizontal external force from the hinge side |
|---|---|---|---|
| Clearances between a door frame and a door |   |   |   |
| Clearances between a bolt and a recess |   |   |   |

FIG. 17

Door Operation at Various Displacements

| | | Door of the Invention | Conventional Door |
|---|---|---|---|
| Displacement | Small | 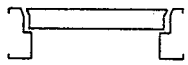 | 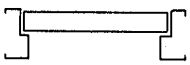 |
| | | Door can be opened and closed easily when deformation is small. | Door can be opened and closed easily when deformation is small. |
| | Moderate | 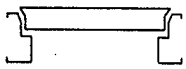 | 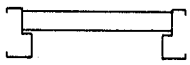 |
| | | Door slides outward along inclined portions of door frame; deformation is absorbed by potions having large clearances. Door can be opened easily. | Door is very difficult to open due to tight contact with the door frame. |
| | Large | 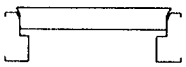 | 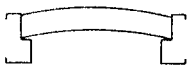 |
| | | Even if the door contacts the door frame, the area of the contact is small. Therefore, it is relatively easy to open the door. | The door is warped and/or hinges are deformed. Therefore, it is impossible to open the door. |

DOOR FOR BUILDINGS

BACKGROUND OF THE INVENTION

The present invention relates to the construction of a door which can be easily opened even if the door frame is deformed by the relative story displacement of the wall of the building at the time of an earthquake.

It is required that entrance doors of high-storied apartments, as well as the room doors and emergency exit doors of schools, hotels, hospitals and other buildings be designed to serve the purpose of protection against fires, noises, crimes, etc. However, earthquakes have been left out of consideration in the design of doors.

According to recent reports of investigation of damages by earthquakes, if walls are subjected to relative story displacement by a strong earthquake, door frames are deformed and it becomes impossible to open the doors. Therefore, it is sometimes impossible to escape from rooms; this is of special concern should a fire break out therein.

Thus, it is necessary to provide a door which can be opened easily even if the door frame is deformed.

In an attempt to meet the need, Japanese Utility Model Application No. Sho. 53-131843 provides a door in which the edge faces thereof and the inner faces of a door frame facing each other are inclined so that the outside panel of the door is larger in area than the inside panel thereof, thereby said door being pushed out of said door frame when said door frame is deformed.

In practice, however, the aforesaid door may not be pushed out of the door frame when the door and the door frame are brought into contact with each other, because large displacements of the door frame and the door, such as may be caused by an earthquake, are not considered in the design thereof with respect to the clearances between the door frame and the door.

In conventional doors, the clearances between the door frame and the door are only 3 to 4 mm and cannot absorb large deformations thereof caused by an earthquake.

With the deformation of the door frame, a dead bolt and a latch bolt of a door lock are vertically displaced within a bolt recess in the door frame. In conventional doors, the upper and lower clearances between the bolts and the bolt recess are so small that in such a case one of the bolts contacts an inner surface of the bolt recess and cannot be withdrawn therefrom.

BRIEF SUMMARY OF THE INVENTION

It is therefore a general object of the invention to provide a door which eliminates all the aforesaid disadvantages of the prior art.

It is a specific object of the invention to provide a door in which the deformation of a door frame by an earthquake is absorbed by the clearances between the door frame and the door, and when the door frame and the door are brought into contact with each other the door is slid toward the outside so as to be easily opened.

It is another specific object of the invention to provide a lock by means of which a door can be locked and unlocked easily with usual force even when a door frame is deformed by an earthquake.

It is a further object of the invention to provide a door which serves the purpose of protection against fires, crimes, etc.

Other objects and advantages of the invention will appear more fully from the following description.

The term "outside" as used herein refers to the side of the door removed from the door-frame stop, as opposed to the "inside" of the door which is the side that contacts the stop.

BRIEF DESCRIPTION OF THE DRAWINGS

FIG. 10 (B) is an enlarged transverse sectional view, in part, of the lock.

FIG. 17 illustrates the operation of doors at various displacements.

DETAILED DESCRIPTION OF THE PREFERRED EMBODIMENTS

Figure 1:
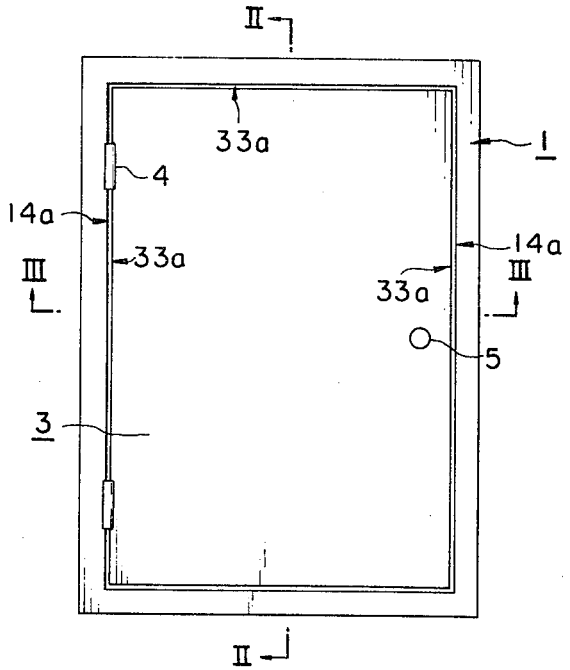
FIG. 1 is a front view of a door of the present invention
Figure 2:
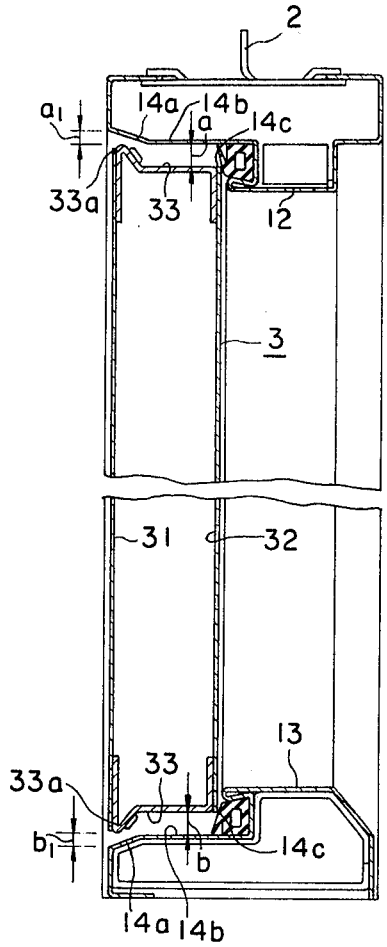
FIG. 2 is an enlarged sectional view taken along the line II—II in FIG. 1.
Figure 3:
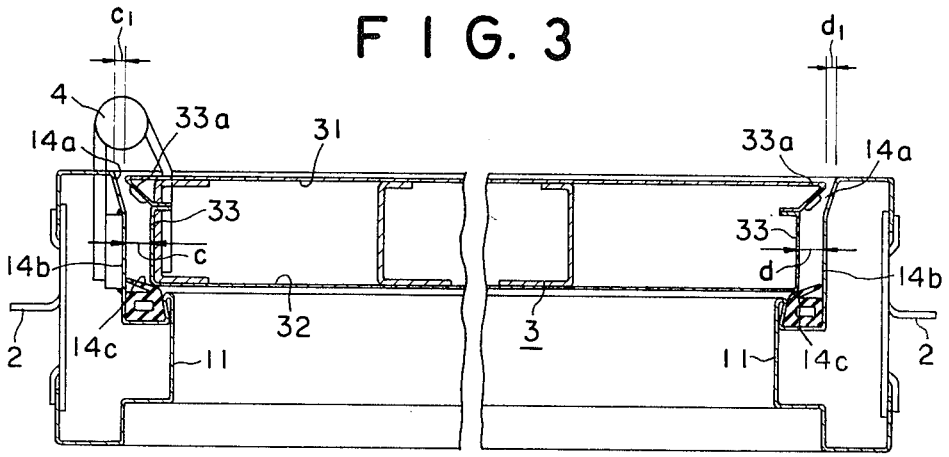
FIG. 3 is an enlarged sectional view taken along the line III—III in FIG. 1.

Referring to FIGS. 1 to 3, numeral 1 represents a door frame fixed in a doorway in a building wall by means of anchors 2 and mortar, etc. The door frame 1 is rectangular, and comprises a pair of jambs 11, a lintel or header 12 and a threshold 13. Numeral 3 represents a door hung within the door frame 1 so as to turn on hinges 4 fastened to the door frame 1 and the door 3. Numeral 5 represents a doorknob.

As shown in FIGS. 2 and 3, the outside panel 31 of the door 3 is larger in area than the inside panel 32 thereof, and the four edge faces 33 of the door 3 are provided on their outside portions with acute-angled projecting portions 33*a*.

The outside portions of the inner faces 14 of the door frame 1 are inclined toward the outside, said inclined portions 14*a* facing the acute-angled projecting portions 33*a* of the door 3 with clearances mentioned below. Numeral 14*b* represents a flat portion which is inward of and adjacent to each inclined portion 14*a*. 14*c* is a doorstop provided next to each flat portion 14*b*.

In FIG. 2, the upper and lower clearances $a_1$ and $b_1$ between the acute-angled projecting portions 33*a* and the inclined portions 14*a* and 2 to 5 mm each, preferably 3 to 4 mm each. In FIG. 3, the right and left clearances $c_1$ and $d_1$ between the acute-angled projecting portions 33*a* and the inclined portions 14*a* are about the same as said clearances $a_1$ and $b_1$. The clearances a, b, c and d between the flat portions 14*b* of the door frame 1 and the edge faces of the door 3 opposing each other are 6 to 8 mm each so that $a_1<a$, $b_1<b$, $c_1<c$ and $d_1<d$.

Figure 4:
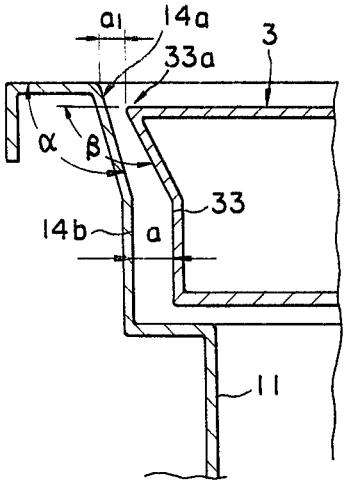
FIG. 4 is an enlarged transverse sectional view, in part, of the door.

As shown in FIG. 4, the angle $\alpha$ of each inclined portion 14*a* is always smaller than the angle $\beta$ of each acute-angled projecting portion 33*a*.

Figure 5:
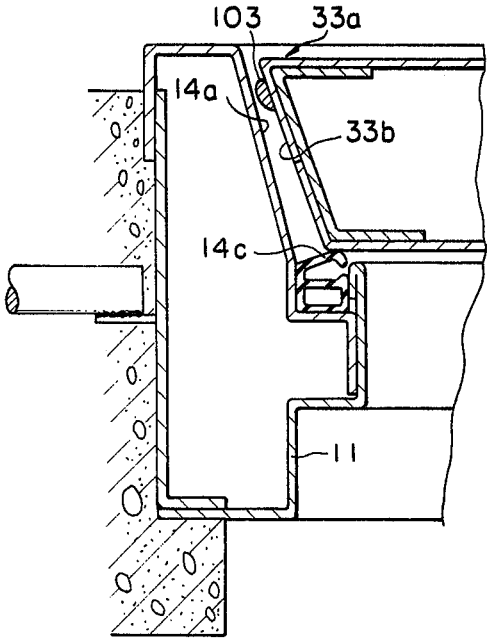
FIGS. 5 to 7 are enlarged transverse sectional views, in part, of modified examples of the door.
Figure 6:
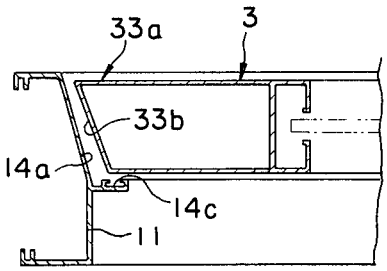
Figure 7:
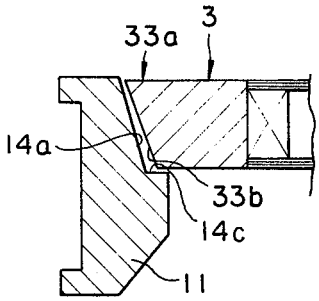

FIGS. 5 to 7 show modified examples of the present invention, in which the entire opposing faces of the door frame 1 and the door 3 are inclined. That is, each inclined portion 14*a* of the door frame 1 continues to each doorstop 14*c*, and each of the four edge faces 33 of the door 3 is a flat and continuously inclined face 33*b* unlike that of the door 3 shown in FIG. 3. In other respects, the examples shown in FIGS. 5 to 7 are basically the same as the example shown in FIG. 3. What is mentioned above concerning the clearances between the door frame 1 and the door 3 as well as the angle of each inclined portion 14*a* of the door frame 1 and the angle of each acute-angled projecting portion 33*a* of the door 3 is applicable also to these modified examples. The door frames and the doors shown in FIGS. 1 to 5 are made of steel plates. The door frame and the door in FIG. 6 are made of aluminum alloy, and those in FIG. 7 are made of wood.

The function and advantages of the door of the present invention will now be described with reference to the drawings.

If external force in the horizontal direction is exerted on buildings, by an earthquake or the like, they are deformed in various ways according to the construction or shape of the buildings themselves or the configuration or nature of the ground on which they stand. The walls (non-load-bearing walls) of high-storied buildings for instance, are subjected to a relative story displacement of 1/150 to 1/120 of the story height at the time of a severe earthquake. In such a case, the walls are cracked, damaged or otherwise deformed, causing the door frames and doors to be deformed and making it impossible or difficult to open or close the doors. If the walls are deformed, even strongly built door frames are almost inevitably deformed thereby. It is difficult in construction and disadvantageous in the cost of materials and construction to let the outer sides of the door frames absorb the deformation of the walls.

Figure 15:
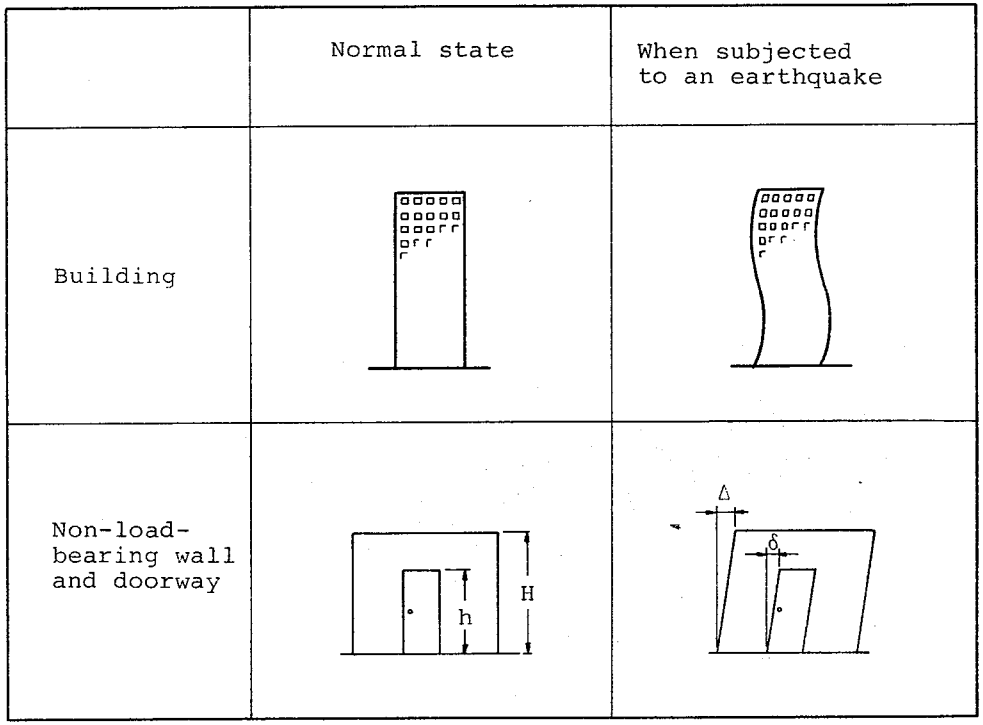
FIGS. 15 and 16 illustrate the displacement effect of external forces on buildings and walls and on clearances of doors and locks.

The displacement effect of external forces is explained further with reference to FIG. 15, where H is the story height, $\Delta$ is the displacement of the wall caused by the external force, h is the door height and $\delta$ is the displacement of the door frame.

Where the relative story displacement of a building wall (non-load-bearing wall) caused by external force is 1/150 of the story height, there is a displacement $\Delta$ of about 20 mm when the story height is 3 m. If the same condition is applied to a door frame having a door height h of 2 m, the displacement $\delta$ of the door frame is obtained as follows:

$$\delta = \frac{h}{150}\ \text{m} = 13.3\ \text{mm}$$

$$\left(\text{provided that } \frac{\Delta}{H} = \frac{\delta}{h}\right)$$

Figure 16:
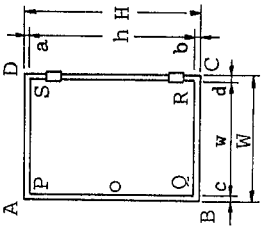
Figure 16:
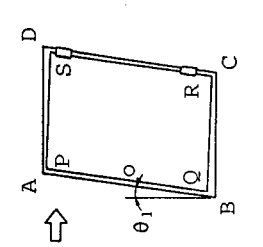
Figure 16:
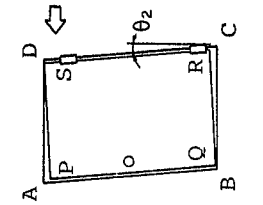
Figure 16:
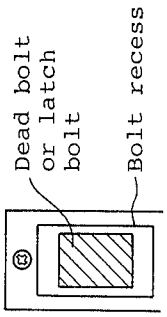
Figure 16:
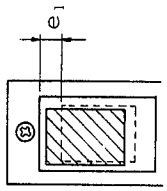
Figure 16:
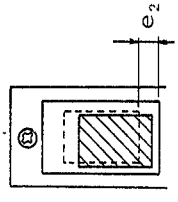

If external force in the horizontal direction is exerted on a building, as at the time of an earthquake, a door frame and a door behave as shown in FIG. 16. In this figure, A, B, C and D designate the inner corners of the door frame, P, Q, R and S the corners of the door, W and H, the inner dimensions of the door frame, w and h the dimensions of the door, a, b, c and d the clearances between the door frame and the door, and the dotted line designates the normal position of the bolt.

When external force is exerted from the lock side, an upper corner P of the door is moved toward an upper inner corner A of the door frame. When said external force is exerted from the hinge side, a lower corner Q of the door is moved toward a lower inner corner B of the door frame. In either case, if the door is brought into contact with the door frame and frictional force is increased, it becomes difficult or impossible to open or close the door. On the assumption that there is no play in the hinges, a displacement angle $\theta_1$ or $\theta_2$ which brings about the above-mentioned state is obtained as follows.

$$\theta_1 = \text{Cos}^{-1}\sqrt{\frac{w^2}{w^2 + a^2}} \approx \frac{a}{w} \quad (1)$$

$$\theta_2 = \text{Cos}^{-1}\sqrt{\frac{w^2}{w^2 + b^2}} \approx \frac{b}{w} \quad (2)$$

Since generally $\theta_1 < \theta_2$ (because a<b), all we should take into account in the case of FIG. 16 (II). If the displacement angle $\theta_1 = 1/150$ (radian), it is apparent from the formula (1) that a door having a width w of 900 mm is kept out of contact with its frame when the upper and lower clearances a and b are at least 6 mm each.

In the present invention, the main clearances a, b, c and d between the inner faces of the door frame 1 and the corresponding edge faces of the door 3 are 6 to 8 mm each. Therefore, if the door frame 1 and/or the door 3 are/is deformed to a small or medium degree by an earthquake, the deformation is absorbed by said clearances. If the deformation is larger and an acute-angled projecting portion 33*a* on an edge face 33 of the door 3 contacts an inclined portion 14*a* provided on an inner face 14 of the door frame 1, the door 3 is slid or sprung toward the outside. (The portion P in FIG. 16 (II) or the portion Q in FIG. 16 (III) is slid out or sprung out.) If the door frame 1 and/or the door 3 are/is deformed to a much larger degree, edge face 33 of the door 3 directly contacts the door frame 1. However, because the area of the contact between them is decreased by said outward movement of the door 3, unlike the case of conventional doors, the door 3 can be opened relatively easily with a small force (see FIG. 17). According to the invention the door 3 easily slides on the inclined portions 14*a* of the door frame 1 toward the outside because said angle $\alpha$ of each inclined portion 14*a* of the door frame 1 is smaller than said angle $\beta$ of each acute-angled projecting portion 33*a* of the door 3. If $\alpha \geqq \beta$ on the contrary, the door 3 does not slide easily toward the outside because the inside portion of an edge face 14 of the door 3 firmly contacts an inner face of the door frame 1 and the area of the contact between them is larger. If it becomes difficult or impossible to open the door as a result of an earthquake, one may be confined to his room. This is a very serious problem especially if a fire breaks out therein.

Even after deformation, the door 3 of the invention can be opened by pushing or striking it from inside the room, so that one can escape from the room safely and surely. To make assurance doubly sure, it is desirable to attach antifriction members 103 to the edge faces of the door 3 and/or the inner faces of the door frame 1 which may contact each other when the door 3 or the door frame is deformed. (See FIG. 5.)

Because the door 3 of the invention is provided on its four edge faces 33 with the acute-angled projecting portions 33*a*, and the clearances $a_1$, $b_1$, $c_1$ and $d_1$ between the projecting portions 33*a* and the inclined portions 14*a* of the door frame 1 are 2 to 5 mm each, there is no fear that the door 3 may be forced open by inserting a bar or the like into one of the clearances.

When the present invention is applied to a fireproof door of metal, it has the following advantages; Said acute-angled projecting portions 33*a* prevent flames from entering the room. Even if the door is expanded by heat, its deformation is absorbed by the large clearances between the door and the door frame. Therefore, the door is virtually free from warping which otherwise would imperil its function of protecting against fire.

A lock suitable for the above-mentioned door will now be described with reference to FIGS. 8 to 14.

Referring to FIGS. 8 to 11, numeral 6 represents a cage or cartridge inserted in or attached to the door 3, and numeral 7 represents a latch bolt contained in an upper or lower portion of the cage 6 so as to slide back and forth. The latch bolt 7 is usually protruded through a face plate 61 by the force of a spring (not shown) disposed within the latch bolt 7, and is completely retracted into the cage 6 when a doorknob 5 or any other means similar thereto is turned to open the door 3. A dead bolt 8 is disposed under or over the latch bolt 7 within the cage 6, and is adapted to be protruded through the face plate 61 and retracted into the cage 6 by means of a thumb turn 51 for instance.

Figure 8:
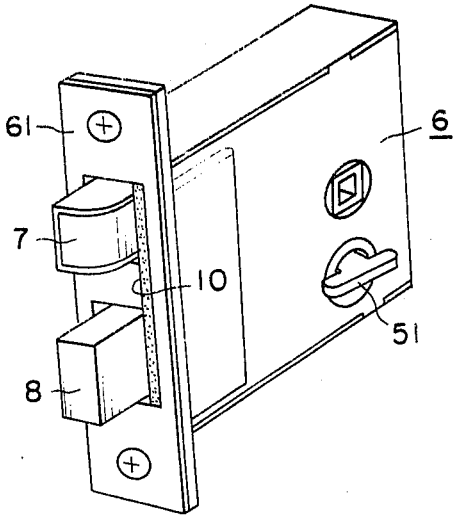
FIG. 8 is a perspective view, in part, of a lock of the present invention.
Figure 9:
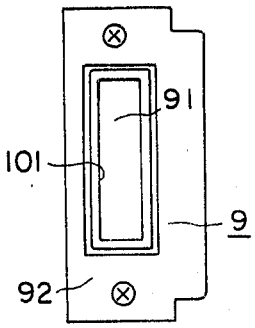
FIG. 9 is a front view of a bolt recess assembly.
Figure 14:
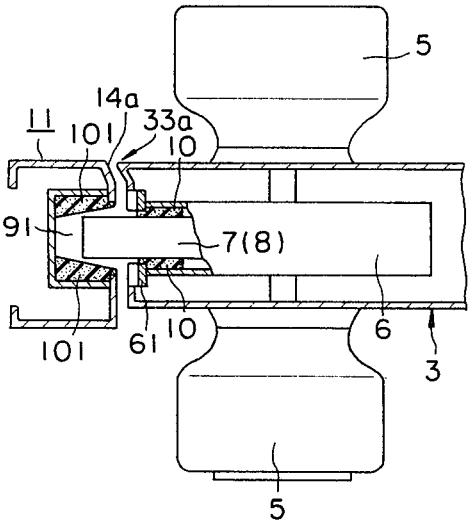

An antifriction member 10, made for instance of a nylon polymer containing molybdenum disulfide ($MoS_2$), an acetal polymer containing oil or any other polymer having a low coefficient of friction or a fluoridized metal, is fixed to a sliding portion or each sliding portion between an inner side or each of both inner sides of the cage 6 and the latch bolt 7 or the dead bolt 8. FIG. 8 shows an example in which the antifriction member 10 is fixed to an inner side of the cage 6. FIG. 14 shows an example in which the anti-friction member 10 is fixed to each of both inner sides of the cage 6.

Figure 10A:
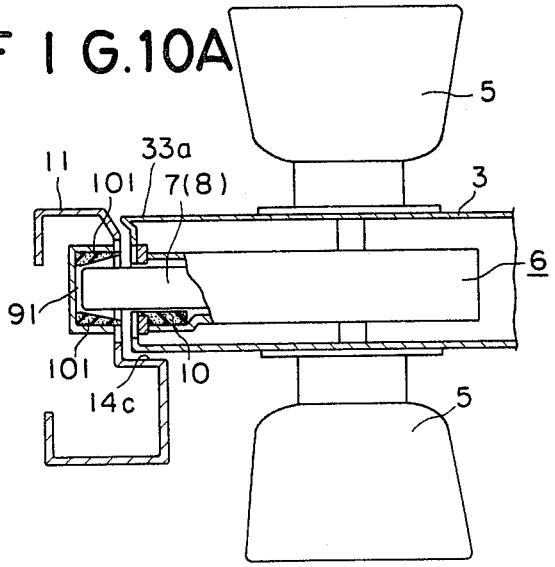
FIG. 10 (A) is a transverse sectional view of the lock.
Figure 11:
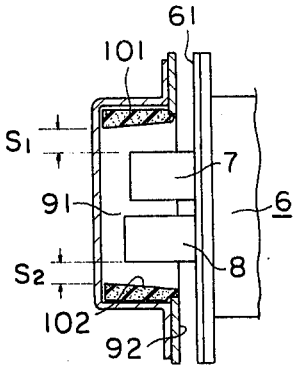
FIG. 11 is a vertical sectional view of the bolt recess assembly.
Figure 10B:
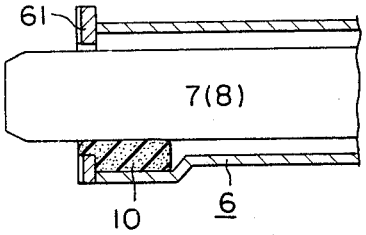
Figure 12:
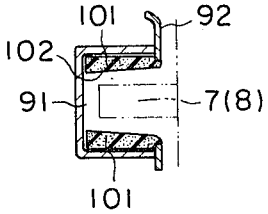
FIG. 12 is a transverse sectional view of the same.

Numeral 9 represents a bolt recess assembly comprising a box-shaped bolt recess 91 into which the end of said latch bolt 7 and the end of said dead bolt 8 are inserted, and a face plate 92 provided in front of the bolt recess 91. The bolt recess 91 is fitted inside with an antifriction member 101 similar to said antifriction member 10, having a low coefficient of friction. The antifriction member 101 inside the bolt recess 91 may be in the form of a sleeve, box or plate. As shown in FIGS. 10 to 12, the inner surface 102 of the antifriction member 101 is inclined so as to decrease its thickness toward the outside.

In the lock having at least one of the latch bolt 7 and the dead bolt 8, there are clearances $S_1$ and $S_2$ of at least 6 mm each, preferably about 7 mm each, between the upper inner surface 102 of the antifriction member 101 and the upper surface of the latch bolt 7 or the dead bolt 8 and between the lower inner surface 102 of the antifriction member 101 and the lower surface of the latch bolt 7 or the dead bolt 8 when at least one of the latch bolt 7 and the dead bolt 8 is inserted into the bolt recess 91 (see FIG. 11). The clearances between each inner side of the antifriction member 101 and each side of the latch bolt 7 or the dead bolt 8 are about 1 to 3 mm each.

Figure 13:
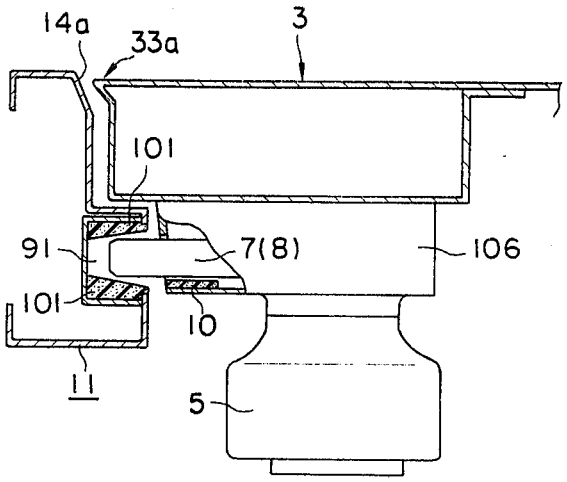
FIGS. 13 and 14 are transverse sectional views of modified examples of the lock.

FIG. 13 shows a modified example in which the latch bolt 7 and the dead bolt 8 are contained in a cage 106 attached externally to the door 3.

The operation and advantages of the lock will now be described.

If the door frame and the door are deformed by an external force, for instance that of an earthquake, the clearances between the door frame and the door are changed, and in some cases the door is brought into contact with the door frame and is slid or sprung toward the outside as mentioned above. Therefore, when the door is locked, a dead bolt and a latch bolt move vertically within a bolt recess and in some cases they firmly contact an inner surface of the bolt recess. Then, it becomes difficult or impossible to turn a thumb turn or a knob, and therefore the dead bolt or the latch bolt may not be released. FIG. 16 shows the behavior of a dead bolt or a latch bolt and the clearances between the bolt and a bolt recess at the time of an earthquake. When the upper or lower edge face of the door is brought into contact with the door frame (FIG. 16 (II), (III), the dead bolt or the latch bolt shows a maximum vertical displacement $e_1$ or $e_2$ as follows.

$$e_1 = a + c\cos\theta_1 - \frac{H}{2}(1 - \cos\theta_1) \approx a \quad (3)$$

$$e_2 = b + c\cos\theta_2 - \frac{H}{2}(1 - \cos\theta_2) \approx b \quad (4)$$

From the formulae (1) to (4), it follows that the dead bolt and the latch bolt are vertically displaced about 6 mm with relation to the bolt recess when the door frame is subjected to deformation of displacement angle $\theta_1 = 1/150$ (radian).

In the lock of the present invention, there are clearances $S_1$ and $S_2$ of at least 6 mm each over and under the latch bolt 7 and the dead bolt 8 inserted into the bolt recess 91. Therefore, even if said bolts 7 and 8 are vertically displaced within the bolt recess 91 at the time of an earthquake, they do not immovably contact the upper or lower inner surface of the bolt recess 91 and the door can be easily unlocked.

If the door frame is greatly deformed, a portion (upper or lower portion) of the door of the present invention is slid on the inclined portion of the door frame toward the outside, and the door itself is twisted 5 to 6 mm. Also, any kind of door may be deformed toward the outside according to the direction of earthquake shocks and the construction of the wall in which the door is fitted. In such cases, the dead bolt and the latch bolt receive shearing force through the bolt recess. In the present invention, owing to the antifriction member 101 having a low coefficient of friction fitted inside the bolt recess and the similar antifriction member or members 10 fixed between the bolts and the inner side or sides of the cage, each of the bolts can be easily released by turning the doorknob or the thumb turn with small force unless the lock is damaged.

What is claimed is:

1. A door for buildings, said door being provided with a lock and hung within a door frame so as to swing on hinges fastened to the door and the door frame, said door frame being fixed in a doorway in a building wall, wherein the outside panel of said door is larger in area than the inside panel thereof, the four edge faces of said door are provided on their outside portions with acute-angled projecting portions, the outside portions of the inner faces of said door frame are inclined toward the outside, clearances of at least 6 mm each between said inner faces of said door frame and the inner portions of said edge faces of said door are provided, and said clearances between said inner faces of said door frame and said edge faces of said door decrease toward the outside.

2. A door for buildings as claimed in claim 1, wherein only the portions of the inner faces of said door frame facing said acute-angled projecting portions on the edge faces of said door are inclined toward the outside.

3. A door for buildings as claimed in claim 1, wherein antifriction members are attached to the edge faces of said door and/or the inner faces of said door frame facing each other.

4. A door for buildings as claimed in claim 1, the lock of which comprises a cage inserted in or attached to said door, at least one of a dead bolt and a latch bolt contained in said cage each being movable back and forth, and a bolt recess inserted in or attached to said door frame into which recess said bolt is inserted, wherein there are clearances of at least 6 mm each over and under said bolt when said bolt is inserted into said bolt recess.

5. A door for buildings as claimed in claim 4 wherein an anti-friction member having a low coefficient of friction is fixed to a sliding portion between said bolt and an inner surface of said cage.

6. A door for buildings as claimed in claim 4, wherein an anit-friction member is fixed to each sliding portion between said bolt and each of both inner sides of said cage.

7. A door for buildings as claimed in claim 4, wherein an anti-friction member having a low coefficient of friction is fitted inside said bolt recess.

8. A door for buildings as claimed in claim 7, wherein the inner surface of said antifriction member fitted inside said bolt recess is inclined so as to decrease its thickness toward the outside.

9. A door for buildings, said door being provided with a lock and hung within a door frame so as to swing on hinges fastened to the door and the door frame, said door frame being fixed in a doorway in a building wall, wherein the outside panel of said door is larger in area than the inside panel thereof, the four edge faces of said door are provided on their outside portions with acute-angled projecting portions, the outside portions of the inner faces of said door frame are inclined toward the outside, clearances of at least 6 mm each between said inner faces of said door frame and the inner portions of said edge faces of said door are provided said clearances between said inner faces of said door frame and said edge faces of said door decrease toward the outside, and there are clearances to 2 to 5 mm each between said acute-angled projecting portions on the edge faces of said door and said inclined portions of said door frame.

* * * * *